US007533887B2

(12) United States Patent
Boyer

(10) Patent No.: US 7,533,887 B2
(45) Date of Patent: May 19, 2009

(54) TABLE GAME, RELATED TOURNAMENT AND ENTERTAINMENT BROADCAST

(76) Inventor: André Boyer, 345, rte. 116 est, Acton Vale, QC (CA) J0H 1A0

( * ) Notice: Subject to any disclaimer, the term of this patent is extended or adjusted under 35 U.S.C. 154(b) by 507 days.

(21) Appl. No.: 11/425,539

(22) Filed: Jun. 21, 2006

(65) Prior Publication Data

US 2006/0232012 A1 Oct. 19, 2006

Related U.S. Application Data

(63) Continuation-in-part of application No. 11/279,842, filed on Apr. 14, 2006, now abandoned.

(60) Provisional application No. 60/671,102, filed on Apr. 14, 2005.

(51) Int. Cl.
*A63F 1/00* (2006.01)
*A63F 3/08* (2006.01)

(52) U.S. Cl. ..... 273/292; 273/274

(58) Field of Classification Search ..... 273/292
See application file for complete search history.

(56) References Cited

U.S. PATENT DOCUMENTS 5,451,054 A 9/1995 Orenstein
5,603,502 A * 2/1997 Nakagawa ..... 273/292
5,975,529 A 11/1999 de Keller
6,077,162 A 6/2000 Weiss
6,206,373 B1 3/2001 Garrod
6,270,405 B1 8/2001 Ferguson
6,511,068 B1 1/2003 Sklansky et al.
2002/0084586 A1 7/2002 Caputo
2002/0123377 A1 9/2002 Shulman
2003/0070178 A1 4/2003 Boyd et al.
2004/0183254 A1 9/2004 Schlumbrecht
2004/0242297 A1 12/2004 Walker et al.
2005/0173862 A1 8/2005 Orenstein
2005/0215300 A1 9/2005 Oliveras

* cited by examiner

*Primary Examiner*—Gene Kim
*Assistant Examiner*—Michael D Dennis
(74) *Attorney, Agent, or Firm*—Novak Druce + Quigg

(57) ABSTRACT

A table card game is provided in which the players at the table play essentially a common card game with the dealer handling the deal essentially as if all players are playing a common game, while handling bets and resolution of winners within two or more groups of players among the players at the table. The table card game can be played with teams. Such teams are made up of players in different groups, playing at a same table, or at different tables. The scoring for a team can then be as a function of the number of teammate players having won as individual players. A broadcast of the card game may contain the information about the play of the game within each group, as well as the progress of the game at the table as a whole. In the case of teams, the broadcast can contain the relevant team information about each team's performance.

23 Claims, 5 Drawing Sheets

TABLE GAME, RELATED TOURNAMENT AND ENTERTAINMENT BROADCAST

This application is a continuation-in-part of U.S. patent application Ser. No. 11/279,842, filed Apr. 14, 2006, now pending having paid the basic fee; which in turn claims priority of U.S. provisional patent application Ser. No. 60/671,102, filed Apr. 14, 2005. This application is related to International PCT Application PCT/IB2005/00170 filed Jun. 26, 2005 designating the United States with the USPTO acting as ISA and IPEA.

FIELD OF THE INVENTION

The present invention relates to a table game, such as a table card game like poker, a table game tournament and a broadcast program based on a table game.

BACKGROUND OF THE INVENTION

One class of table card games, such as many forms of poker, involves a number of players around a table in a contest against each other over a number of games to determine a winner among the players. In the case of poker, the winner is typically the single player taking the whole pot collected from all eliminated players. Such "player against player" games have an appeal that "player against dealer" cannot offer, since the play of the game involves the skill and luck of all players against all players over an extended period of play during which many events and challenges take place and players are eliminated. This appeal makes such games more interesting as a spectator event, and televised table card tournaments are known in the art.

Many such table card games are played in casinos and gaming halls in which a dealer, who does not participate in playing the game, manages dealing of cards, handling of bets and payouts or transfer of winnings among players. When five to ten players at a table participate in such a game, considerable time is spent playing the game with some players eliminated from the table. During this time, the ratio of tables and dealers to players is much less efficient in terms of overhead.

Texas Holdem is one type of poker that can be played at a table and is presently very popular. In each game, each player is dealt two cards face down and then five community cards are turned up on the board. Each player makes the best five card hand using any combination of the seven cards. There are four betting rounds. Each player must bet or raise at each round. To start a new hand, two "blind" bets are put up or "posted". The player immediately to the left of the dealer puts up or "posts" the small blind. The player to the left of the small blind posts the big blind that is a larger bet amount. The rest of the players do not put any money to start the hand. Because the dealer rotates around the table, each player will eventually act as the big hand and, small blind hand dealer. Each player is then dealt two cards face down with the player on the small blind receiving the first card and the player with the dealer button getting the last card. The first betting round begins with the player to the left of the big blind either putting in an amount to call the blind bet, or putting in a larger amount to raise the big blind, or folding his hand. The betting goes around the table in the usual sequence until the player who posted the small blind who can call the bet by putting in a bet since a small bet was already posted. The last person to act is the big blind. If no one has raised, the dealer will ask if they would like the option, this means the big blind has the option to raise or just "check". By checking, the player does not put in any more money.

After the first betting round is completed, three cards are dealt and turned face up in the middle of the table. This is known as the "flop". These are community cards used by all the players. Another betting round begins with the first active player to the left of the dealer button. The bet for this round is again set to a predetermined amount. When the betting round after the flop is completed, the dealer turns a fourth card face up in the middle of the table. This is called the "turn". The bet after the turn is now a predetermined amount and begins again with the first active player to the left of the dealer. Following the betting round for the turn, the dealer will turn a fifth and final card face up. This card is called the "river", and the final betting round begins with a predetermined amount being the minimum bet.

To determine the winner, the players may use any combination of their two hole cards and the five cards on the board or "table" to form the highest five-card hand. In the case that the best hand of all players is the five cards on the board, the active players will split the pot. A sixth card is never used to break a tie. Texas Holdem is an easy game to learn, and yet is difficult enough to master to be interesting. Many betting opportunities are provided per game. The use of the flop makes the game particularly interesting since the two player held hole cards determine in most cases a differential or variation to a common core provided by the flop. In poker games without community cards, the player hands are of diverse composition and scoring, while in Texas Holdem, the players vie to make the best completion of the flop. For spectators and players alike, the attention becomes more focused, namely on expectations for the best completion of, or for complementary cards, to the flop for each active player.

SUMMARY OF THE INVENTION

It is an object of the present invention to provide a table card game in which the players at the table play essentially a common card game with the dealer handling the deal essentially as if all players are playing a common game, while handling bets and resolution of winners within two or more groups of players among the players at the table.

When the groups contain two players, the invention allows for "Heads-Up" games to be played in which it is each player against a single opponent. Preferably, such embodiments involve players to be seated opposite their opponents, with players being seated on the opposite lengthwise sides of an elongated table.

The invention can also allow for a table card game to be played with teams. Such teams are made up of players in different groups, preferably playing at a same table, but also possibly at different tables. The scoring for a team can then be as a function of the number of teammate players having won as individual players.

In the case of a tournament, the basic condition that players of a single group will be at the same stage within the tournament is respected, however, the invention allows for the groups at a same table to be at different stages within the tournament. This may be done to complete an elimination round at a tournament more quickly using a predetermined number of tables and dealers by substituting a group that has completed its elimination round by a group that has yet to begin its elimination round. The substitution group can be a group of players starting the same level as the group having just finished, or a group of players starting the next round. In some cases, it may be preferred to have a round completed before allowing any players begin playing in the next. Preferably, players will be allowed to finish a round at a same table without needing to move, although new neighbors at the table will join in as different groups. The invention can be used either to allow an elimination round to be operated with fewer tables than is required to accommodate all players in the round and/or to allow the next round to begin using spaces at tables vacated by eliminated groups in the current round.

The number of players in a group can be two (for a Heads-Up style of game), three (preferably three groups of three players can be placed at a table of nine players), or four (preferably two groups at a table). A table may also accommodate groups of different sizes, such as for example, a group of four and two groups of two, or two groups of three and a group of two. The group sizes can also be determined to meet the wishes of players, namely a table normally arranged for Heads-Up groups of two could welcome a group of three or four when space becomes available. Likewise a table having two groups of four players may welcome a group of two as soon as the first two players at the table are eliminated, and in this case, there is a good probability that the new group of players completes its competition roughly at the same time as the other larger groups. One can alternatively start with one group of eight players and bring in new groups of two, three or four as the spaces become available as a result of players leaving the table. Each group size has its own appeal, and even if groups of two ensure that no player space at a table needs to be unused, groups of three or more can be economically interesting as well.

The invention can also be used to improve the interest of viewers of a broadcast program based on a table card game. Such a broadcast contains the information about the play of the game within each group, as well as the progress of the game at the table as a whole. In the case of teams, the broadcast can contain the relevant team information about each team's performance.

The invention also provides different team score evaluation techniques, some based on the ability for strong players to support weaker players on a same team, other based on independent play of players on a same team with a scoring mechanism to determine the strongest or winning team.

The present invention can be applied to casino table games other than poker or even card games. In the case of card games where the players normally compete or play against the dealer, the invention allows for teams of players to compete against each other, either as a function of individual performance against the dealer or as a function of a direct comparison of faming symbols obtained during a game among the players. The invention can thus be an auxiliary component to such games. Likewise, in the case of roulette or craps, the invention can allow for teams to be formed. This gives a team spirit and team competition component to such games that increases interest, particularly when applied to charity, celebrity or corporate social events where there is an interest in the social interaction among players.

BRIEF DESCRIPTION OF THE DRAWINGS

The invention will be better understood by way of the following description of embodiments of the invention with reference to the appended drawings, in which.

DETAILED DESCRIPTION OF THE EMBODIMENTS

Figure 1:
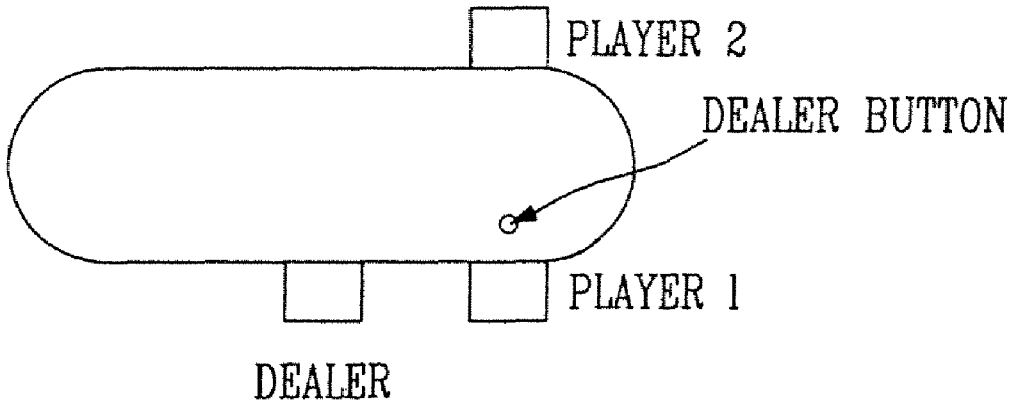
FIG. 1 (PRIOR ART)
FIG. 1 illustrates a plan view of a heads-up style card game table in accordance with the prior art played at the end of a tournament round when only two players are left.
Figure 2:
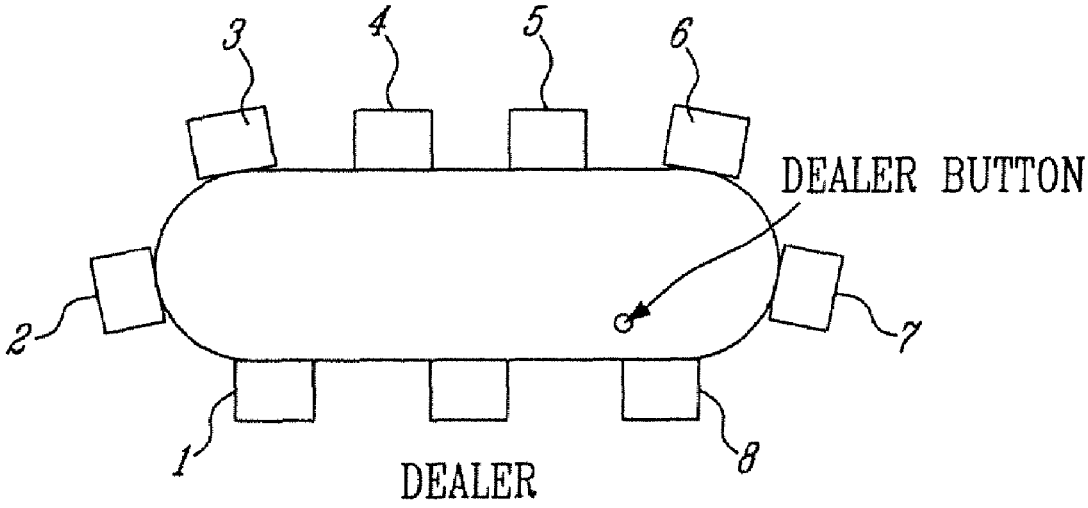
FIG. 2 (PRIOR ART)
FIG. 2 illustrates a plan view of a conventional table card game seating arrangement with eight-player positions and the dealer in accordance with the prior art.

FIGS. 1 and 2 illustrate table card game table player place arrangements in accordance with the prior art. In the case of FIG. 1, a heads-up game is being played and there are only two players, namely Player 1 and Player 2 at the table with one dealer position. A dealer button is used to determine the starting point for the deal between the two players, as is known in the art of Texas Holdem. In the case of FIG. 2, the table has eight player places, and the dealer is located centrally for the purposes of handling the dealing of cards and management of bets for the players. The players play against all others at the table, and there is a single pot to be won at the table each hand. As a number of hands is played in a tournament, players who lose all of their chips are eliminated from the table until there is a last pair of players at the table, and finally one of these two players is the winner taking all of the chips from all players at the table. In a cash game, players who lose all their money have the option of leaving the table or putting up more money.

Figure 3:
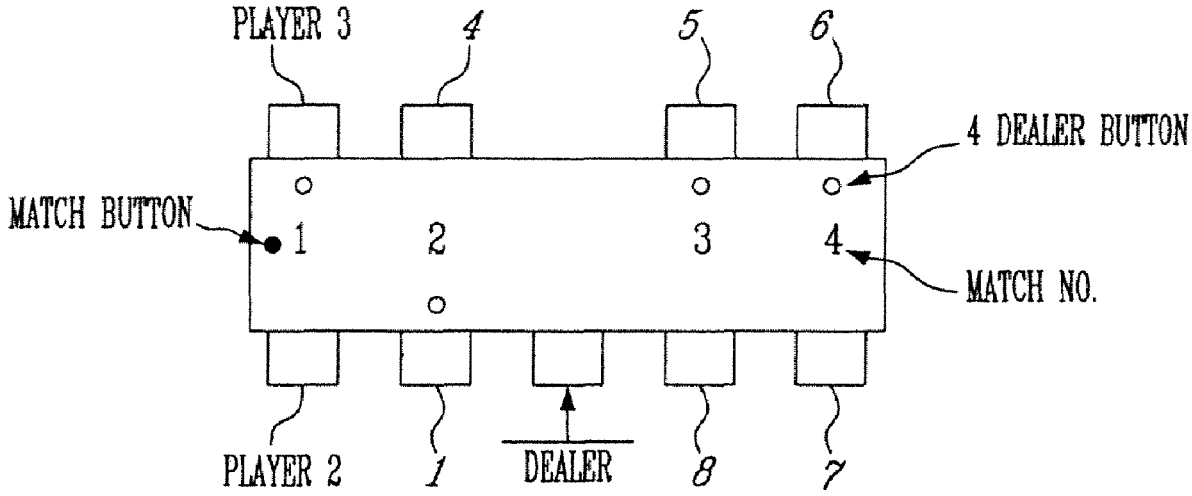
FIG. 3 illustrates a plan view of a table card game table arrangement having eight-player positions arranged in four groups of two players facing each other on opposite longitudinal side on an elongated table.

In the embodiment of FIG. 3, four independent groups of two players are arranged at a rectangular table with each group of players being arranged on opposite sides of the table. In the preferred embodiment, the game being played is Texas Holdem. In addition to having four dealer buttons, one for each group of players, a match button is added for determining which group will act first on every round of betting. While the dealer deals cards to the players initially as if all players were involved in the very same game of Texas Holdem, and the dealer adds cards to the flop which is common to all players at the table, betting and the resolution of the bets is performed on a group by group basis in an orderly manner beginning with the group identified by the match button. The determination for the initial position of the dealer button for each group and also the determination for the initial position for the match button is performed in accordance with the known methods for determining the initial player such as drawing a card to determine a winner of a starting position.

Preferably, to prevent confusion, all the players with the dealer button will post the small blind, while the opposing player will post the big blind. The dealer starts the hand dealing two cards face down to each player, starting with the player sitting to his left. The action is now on the group that has the match button. On that round of betting, the player with the dealer button has to act first. His options are to concede his small blind or match the size of the big blind or, if the game played is limited, raise to a predetermined amount, and in the case of a no limit game, he or she can raise with all the chips or money that he as on the table. In a no limit game, a subsequent player who cannot match the no limit raise typically has the option of matching with all of his or her chips, and the dealer returns the difference to those players previously having matched the higher no limit bet. If he concedes his small blind, the action is over with for that group for the remaining of that hand. The action is now on the next group sitting to the right of the match button. Like on the previous group, the player with the dealer button acts first with the same options as the previous group.

When all groups have acted, the dealer, after burning a card, turns three community cards face up in the middle of the table, which is called the flop. The action is now on the group with the match button or in the case that they have dropped out of that hand, the action is on the group sitting on the right of the match button. For that and all the remaining rounds of betting, the players that started with the big blind will be acting first. His options are to check or bet when the action is completed it goes to the next group. When all remaining groups have acted, the dealer burns one card and adds one more card to the flop, called the turn. The action is back to the group with the match button or the next group. All the players of the remaining groups have the same options than the previous round of betting. When all remaining groups have acted, the dealer burns one more card and add the fifth and last card, which is called the river. This is followed by the last round of betting with the players having the same options than the previous round of betting.

When all remaining groups have acted, all remaining players turn their hole cards face up and the winners of all remaining groups take the pot in front of him. The dealer now moves the match button to the next group and, after shuffling the cards, starts dealing the next hand. In a cash game, when a player loses all his chips or money, that player has the option of leaving the table or putting more chips or money on the table to keep playing. Any player can leave a game anytime, at his own discretion. In a tournament, when a player loses all his chips, he is eliminated from the event. The winner moves to the next level of that tournament.

The players at the table shown FIG. 3, while all playing with a common flop and common dealing of cards, may be in groups that are not at the same stage of a tournament. For example, players 3 and 4 may complete the first elimination round before players 1,2,5,6,7,8. Two new players who have not yet started to play in the tournament can replace players 3 and 4 and begin the first round. When all players in the tournament have played the first round, and then places become free at tables in the tournament, second round players can occupy places at tables where other players are still involved in their first round. Since betting is handled independently within the groups, the dealer can apply different betting amounts to groups playing within different rounds in the tournament at the same table.

Figure 4:
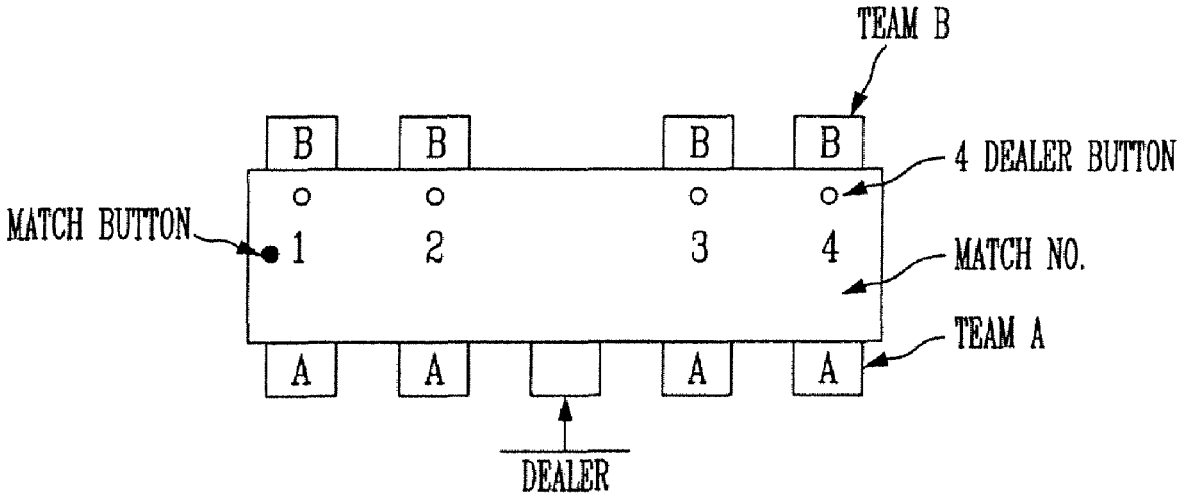
FIG. 4 is an illustration similar to FIG. 3 with the exception that the players on each side of the table belong to teams, namely Team A on one side and Team B on the other side.

In the embodiment of FIG. 4, four of the players belong to one team, namely Team A while the other four players belong to Team B. Each member of the team plays against a single player of the opponent team until a winner is determined between the two players in each group. With four pairs of players at the table, and four members per team, it is possible for such teams to tie. Alternatively, by providing an odd number of players per team, it is possible for tie games or matches to be eliminated. In the case of teams, the four dealer buttons are assigned to all players of the same team. In this example, the teams have four players. The match button is set on match number 1 as shown in FIG. 4. A chosen player of each team draws a card. The highest card determines which team will start with the dealer button. As shown in FIG. 4, Team B has won the dealer button. The dealer starts the hand by dealing two cards face down to each players starting with the player sitting to his left. The same rules and execution applies as described in FIG. 3. Except when a player loses all his chips, he is eliminated and the winning player scores one point for his team. Various options can be done with the chips of the winning player:

1) They can be removed from the table;
2) Split equally between the remaining teammates;
3) Pass on to the teammate with the lowest amount of chips.

The same applies when the other players lose their chips. With four players per team, the final score could be 4-0, 3-1, 2-2. To prevent a tie score, an odd number of players per team are required.

Figure 7:
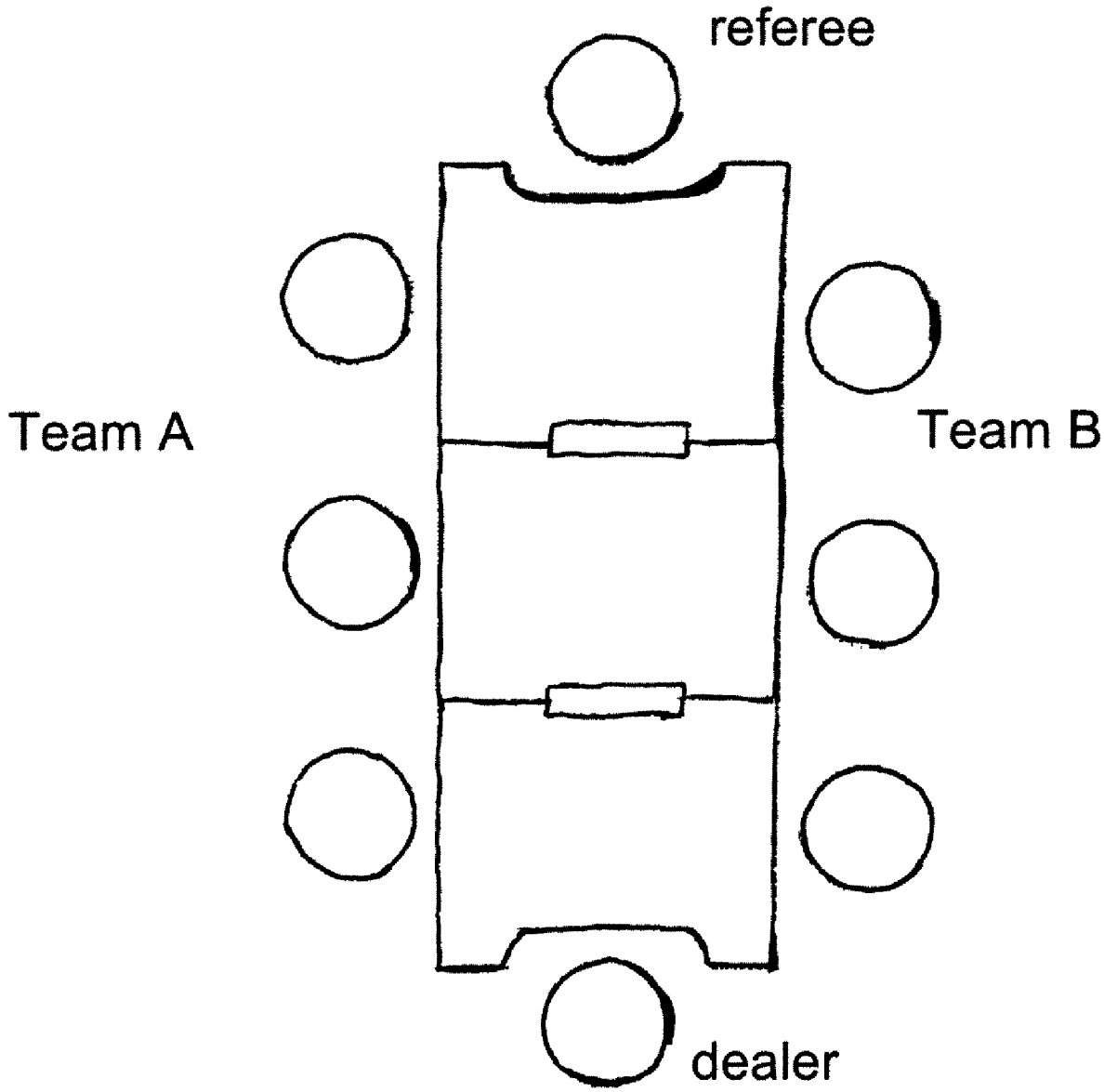
FIG. 7 illustrates a modified poker table layout suitable for heads-up play.

In the embodiment of FIG. 7, the table layout accommodates a dealer at an end of the table, slightly inset as shown, dealing to six players, namely three pairs of heads-up players. This arrangement is advantageous for teams of three players. The player position opposite the dealer may be reserved for a judge in a tournament, or it may be used when a mixed arrangement of players is allowed and a group of three (or 5 or 7) players is present at the table.

The table may be arranged to accommodate between 2 and up to 20 players. With a single deck of cards, the game can be played with 20 players if each player is given two cards and there is a flop of 5 cards with 3 cards being discarded by the dealer (this makes 48 cards from the deck). For cost benefits and comfort, tables with between 4 and 10 players are desirable. When there are more than three positions between a dealer and a player receiving physical cards, it may be suitable to use a card conveyor to physically deliver cards from the dealer to players. The card conveyor may be a mechanical conveyor belt integrated into the table for moving cards placed face down on the conveyor to be in front of players so they can collect them.

Alternatively, live table games can also be played with virtual cards that the players receive and manipulate using display devices. The latter allows for a physical dealer to be optional.

The ability to play a table game in teams is advantageous. An increased interest is generated when a team spirit and team competition component is added to such games. This is particularly the case when applied to teams based on a strong identity such as country of origin. However, it is also applicable when teams are based on corporate identity or celebrity personalities, such as for corporate social events and charity or celebrity events. In these cases, there is an interest in the social interaction among players.

When teams are involved, the method of evaluating or scoring teams is a component of the overall game. As will be appreciated, with two teams of three heads-up player pairs, as shown in FIG. 7, the determination of a winning team can be as simple as resolving a winner within each heads-up pair and then determining the winning team as the one that has two or more winning players. In this case, each player could begin with a fixed value of chips or tokens, and a winner of a heads-up pair is declared when one of the two players wins all chips or tokens from his or her opponent. However, other methods are also possible.

In one such embodiment, when a player wins against his or her heads-up opponent, the chips or tokens won are distributed among the winner's teammates. This has the effect of strengthening the playing power of the teammates. This can also be advantageous in the case of an even number of players at a table, since the chances are slim that the last two heads-up pairs would conclude at the same time, thus ending in a tie game. The distribution of the chips or tokens won can be even among teammates, or alternatively can be uneven, namely either given entirely to a single player or divided unevenly. Such uneven distribution may be decided by the winning player, or by a fixed convention (e.g. the teammate with the fewest chips), or by a team captain.

In another such embodiment, borrowing of chips or tokens from teammates is allowed, the rules for such borrowing being established. For example, the rules may allow for any player to borrow from a teammate up to 10% of the value of the tokens given to each player at the beginning of the match, and the lender may accept or refuse the loan. The loan is for the purposes of making a bet that the borrower could not otherwise afford to make, and if the borrower wins his hand, the loan is to be repaid immediately. A loan is not for a player who has already lost and who wishes to stay in the game, and instead is an option for a player ready or forced to be "all in". The rules will dictate whether an opponent can oblige a player to take loan to match a bet, or whether a player may choose to not to borrow so that team mates are not disadvantaged by his or her loss. Loan repayment can be with full interest, namely double the amount, or interest-free, as the rules may dictate. Such exchange of value among teammates makes for more interesting team play, and adds a strategic component to team play behavior. A player who borrows to make a bet also sends a strong signal of confidence, an important element in poker where bluffing is an essential component of play of the game.

In another such embodiment, the rules allow for a player to issue a challenge to the opponent of the player's teammate when the player's teammate decides to fold. The interest for the opponent in accepting the challenge is to be able to weaken the challenger for the benefit of the opponent's teammates, since the challenger must put on the table the additional amount required beyond what the folding player had bet to match the bet of the opponent. This additional amount is physically placed in an area reserved for challenge amounts a little to the side of the bet made in the game against the challenger's heads-up opponent. If the challenger wins, his or her teammate wins the amount that he or she had bet before folding, while the challenger wins the additional amount. If the challenger loses, the opponent takes the additional amount along with the bet that was folded.

This embodiment allows for the game to be played with a team versus team element that mere heads-up does not provide. A large bet that may be a bluff can be challenged by any of the opponent's teammates. A refusal to accept a challenge may be a sign of weakness that some players will not want to demonstrate.

Figure 5:
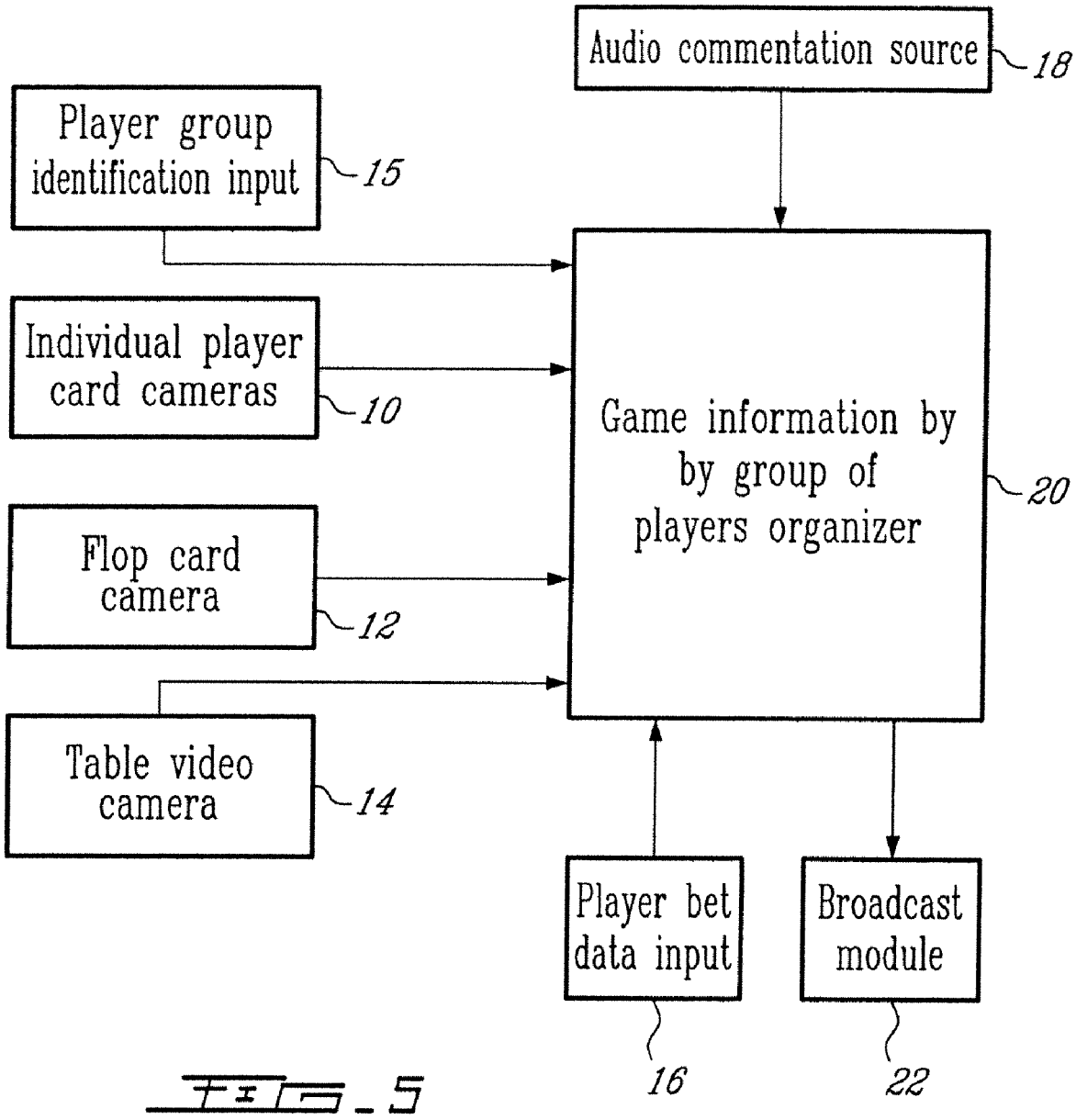
FIG. 5 is a block diagram of the broadcast program content generation system in accordance with one embodiment of the invention.

As illustrated in FIG. 5, when the game according to the invention is made the subject of a broadcast program, various sources of information such as the cards dealt, the cards played or in the flop and the player bet data must be collected and provided to the spectator of the event in order to follow with interest. In the embodiment of FIG. 5, individual player card cameras 10 are provided at each player position around the table in order to record the information concerning the cards, namely the image of the cards, held by the individual players. A flop card camera, mounted from the ceiling or from a stand mounted on the table, is used to collect an image of the cards in the flop. A video camera 14 is used to collect an image of the players sitting at the table, and it will be appreciated that the table video camera 14 may comprise a set of cameras providing different views, namely views of individual players in addition to views of the table from different angles. A player bet data input module 16 is also provided. Such input module 16 may comprise sensors associated with the table 4 for collecting data automatically about bets placed, or a data input terminal for inputting a data concerning the bets. In the latter case, the dealer or another observer may input the information concerning the bets made. A player group identification input 15 is also provided to be able to identify which group is currently in the process of playing or betting so that a suitable organization of the information may be performed by the game information organization module 20. A commentator may also provide spectators of the broadcast program with commentary of the game. Such audio is provided from a source defined in FIG. 5 as block 18. The data is suitably combined by the organizer 20 to provide a broadcast program to a broadcast module 22 for broadcast.

Figure 6:
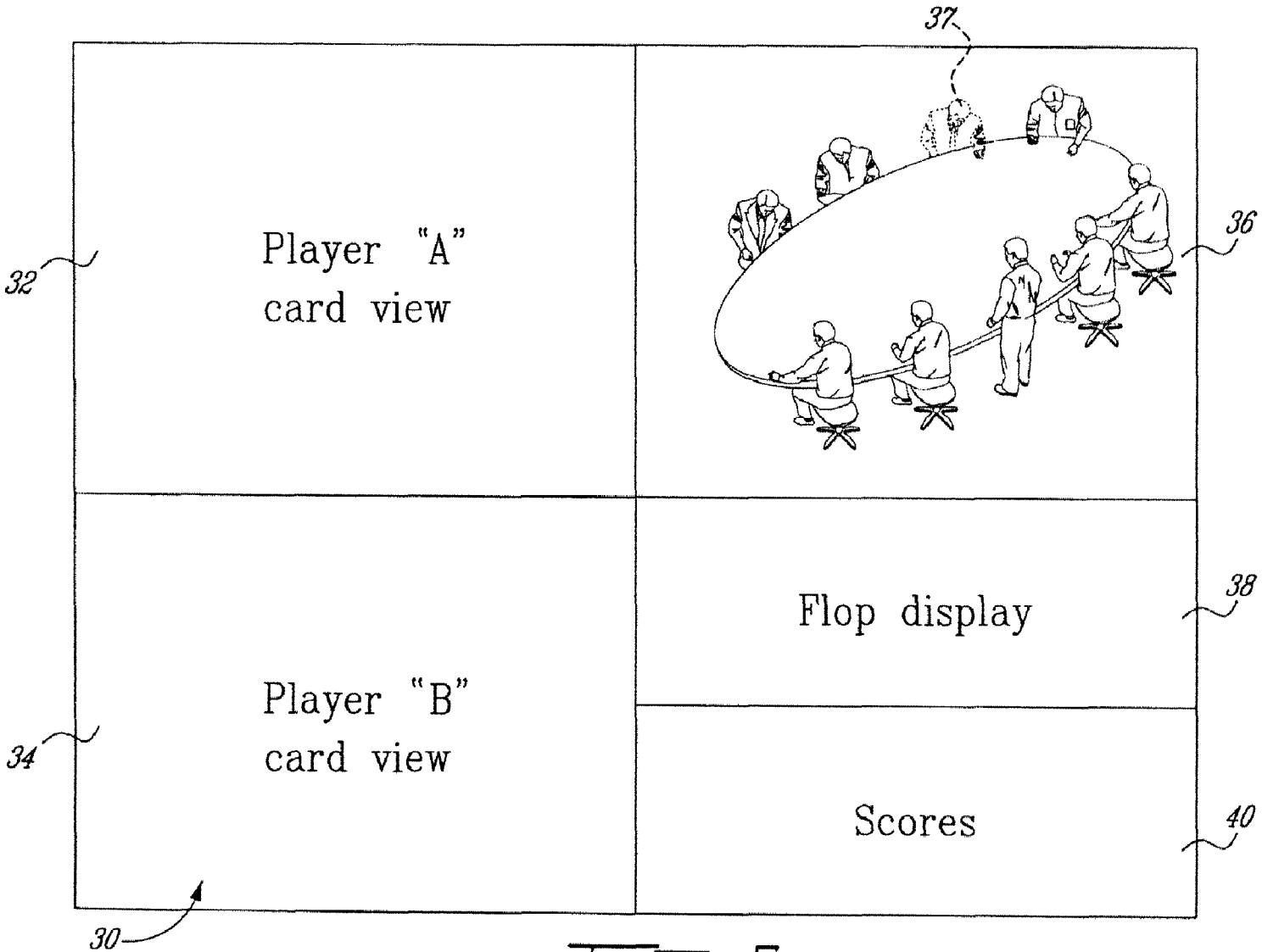
FIG. 6 illustrates a screen view of a broadcast program divided essentially into four quadrants, namely a first quadrant showing the cards held by a player A, a second quadrant showing the cards held by player B, a third quadrant showing a view of all players sitting at the table of the table card game, and a fourth quadrant providing a display of the flop and the scores for the individual groups playing at the table card game in accordance with one embodiment in which the table game is Texas Holdem Poker.

FIG. 6 illustrates an example of how a combined information display may be provided within such broadcast. The screen 30 comprises a first quadrant 32 which provides a visual representation of the cards held by Player A, a second quadrant showing the visual representation of the cards held by Player B at 34, and another quadrant includes the video feed from camera 14. The video feed in quadrant 36 preferably contains a highlight or other indication of the players 37 that are part of a group currently playing and whose cards are highlighted in the quadrant 32 and 34. In another quadrant, there is a portion 38 for showing the flop of the Texas Holdem game, and another portion 40 for illustrating the scores of the players. The score illustrated may be limited to the group highlighted and illustrated in quadrant 36, and alternatively it may illustrate the scores of all groups of players at the table.

It will be appreciated that the broadcast program be displayed using a large screen having its display surface divided into quadrants. However, for regular television or web broadcasting, it will be appreciated that the screen will typically contain one single view with the occasional small overlay or picture-in-picture of a player's cards or of the flop cards or of bets and scoring. Thus, the organization of the information is more sequential arranging of content to show player views, table views, statistics, bets and scores, and cards held and played, with preferably an audio track of a commentator explaining the play and strategies involved.

It will be appreciated that the present invention may be performed with different table games and with different arrangements of groups of players than as described with reference to the drawings.

In the following, a comparison is made between a tournament performed in accordance with the prior art and in accordance with the invention. The tournament would be for Texas Holdem Poker with eight players per table. In the example, the tournament would begin with 200 players.

Resources Required for a Tournament with 200 Players According to Prior Art Rules:

1) 25 dealers and tables are needed for 8 hours;
2) only 50 players per round, 4 two hours round is needed;
3) after 8 hours of playing, 100 players remain.
4) The second round starts with 100 players;
5) 25 dealers and tables are needed for 4 hours;
6) after 4 hours of playing, 50 players remain.
7) The third round starts with 50 players;
8) 25 dealers and tables are needed for 2 hours;
9) 25 players remained in the game. There will be a draw to find the player that will get a free pass to the next round. If the chosen player makes it to the final two players, he will have to win 2 matches, except if it is a player that also had a free pass.
10) The fourth round starts with 24 players;
11) 12 dealers and tables are needed for 2 hours;

12) 12 players and the player with the free pass. Out of the 12 players there will be a draw to choose the player that will get a free pass.
13) The fifth round starts with 12 players;
14) 6 dealers and tables are needed for 2 hours;
15) 6 players and the player with the free pass. Out of the 6 players there will be a draw. A player can only have one free pass.
16) The sixth round starts with 6 players;
17) 3 dealers and tables are needed for 2 hours;
18) 3 players plus the player with the free pass.
19) The seventh round is the semi final;
20) 2 dealers and two tables are needed for 2 hours.
21) The final match needs one dealer for 4 hours max.

Total time for completion of the tournament is 26 hours. Total of dealer hours is 400, calculated as follows:

1) 25 dealers and tables are needed for 14 hours; total hours 25×14=350 hours;
2) 12 dealers and tables are needed for 2 hours; total hours 12×2=24 hours;
3) 6 dealers and tables are needed for 2 hours; total hours 6×2=12 hours;
4) 3 dealers and tables are needed for 2 hours; total hours 3×2=6 hours;
5) 2 dealers and tables are needed for 2 hours; total hours 2×2=4 hours;
6) 1 dealer and table for a maximum of 4 hours; total hours 4 hours.

Resources Required for a Tournament with 200 Players in Accordance with Preferred Embodiment:

1) 25 dealers and 25 tables of 8 players;
2) every time 8 players are eliminated, you reduce the number of table and dealer;
3) after 2 hours of playing, the first round is over.
4) The second round starts with 100 players;
5) 13 dealers for 13 tables, 12 tables with 8 players, and 1 table with 4 players;
6) every time 8 players are eliminated, you reduce the number of tables;
7) after 2 hours of playing, the second round is over.
8) The third round starts with 50 players;
9) 7 dealers for 7 tables, 6 tables with 8 players, and 1 table with 2 players;
10) every time 8 players are eliminated, you reduce the number of tables;
11) after 2 hours of playing, the third round is over.
12) The fourth round starts with 24 players, one player will get a free pass;
13) 3 dealers and 3 tables are needed;
14) after 2 hours of playing, the fourth round is over.
15) 6 players remains and the player with the free pass.
16) Out of the 12 players, one will get a free pass for the next round.
17) The fifth round starts with 12 players;
18) 2 dealers and 2 tables are needed;
19) after 2 hours of playing, the fifth round is over.
20) 6 players remains and the player with the free pass.
21) Out of the 6 players, one will get a free pass. A player cannot get more than one free pass.
22) The sixth round starts with 6 players;
23) 1 dealer and 1 table is needed;
24) after 2 hours of playing, the sixth round is over.
25) 3 players remains and the player with the free pass.
26) The seventh round is the semi final with 4 players;
27) after 2 hours of playing, the seventh round is over.
28) The final round, if the remaining 2 players have not won a free pass or if both players have won a free pass, there will only be 1 match. If only one player has won a free pass, this player will need to win 2 matches to be declared the winner. The other player will need to win only one match. the final could last up to 4 hours.

Total time for completion of tournament is 12 hours. Total of dealer hours is 106.

What is claimed is:

1. A method of playing a table card game comprising:

selecting a card game having rules suitable for play by four or more players at a table under control of a dealer to deal cards, manage bets, determine a winner and provide a corresponding payout;

providing a gaming table with places for said players arranged to play in at least two group of at least two said players;

providing a dealer button for each said group;

providing a match button to determine a starting group at said table;

managing bets from said players and determining said winner and corresponding payout in accordance with said rules of said game within each of said groups, beginning with the starting group determined by the match button; and dealing cards to said players in accordance with said rules of said game as if said players were part of a single group.

2. The method as claimed in claim 1, wherein said gaming table has places for eight players, each said group comprising two players essentially facing each other across said table.

3. The method as claimed in claim 1, wherein said card game is Texas Hold'Em.

4. The method as claimed in claim 3, wherein said rules provide for elimination of a player after play of multiple games until a non-eliminated winner of a series of games is completed, further comprising determining when a series of games is completed for each of said groups of said players, and continuing play of said game for a remainder of said groups.

5. The method as claimed in claim 4, wherein when a series of games is completed for one of said group of players, said one of said group of players is replaced by a new group of players.

6. The method as claimed in claim 1, wherein said rules provide for elimination of players after play of multiple games until a non-eliminated winner of a series of games is completed, further comprising determining when a series of games is completed for each of said groups of said players, and continuing play of said game for a remainder of said groups.

7. The method as claimed in claim 6, wherein when a series of games is completed for one of said group of players, said one of said group of players is replaced by a new group of players.

8. The method as claimed in claim 1, wherein each said group comprises two players essentially facing each other across said table, and players from a same side of said table belong to a same team, further comprising determining a winning team from a number of players from a same team who have won in their respective groups.

9. The method as claimed in claim 1, wherein each said group comprises a same number of players.

10. A method of playing a table card game tournament comprising:

a) selecting a card game having rules suitable for play by four or more players at a table under control of a dealer to deal cards, manage bets, determine a winner and provide a corresponding payout, said rules provide for elimination of a player after play of multiple games until a non-eliminated winner of a series of games is determined, a number of games in said series being essentially randomly determined for each series;

b) providing a number of gaming tables, each one of said gaming tables having places for said players arranged to play in at least two groups of at least two of said players;

c) determining a first number of players participating in said tournament, said first number being greater than a number of places at said number of gaming tables;

d) dividing said first number of players into a second number of said groups of equal number of players;

e) assigning some of said groups of said players from said second number of groups to fill said places at said gaming tables and play said card game;

f) providing a dealer button for each said group;

g) providing a match button to determine a starting group at each of said gaming tables;

h) managing bets from said players and determining said winner and corresponding payout in accordance with said rules of said game within each of said groups, beginning with the starting group at each of said gaming tables determined by the match button;

i) dealing cards to said players in accordance with said rules of said game as if said players were part of a single group;

j) until all said groups have been assigned to play, replacing groups of said players with groups not yet assigned to play in step (e) as series of games are completed for said groups, and continuing play of said game for a remainder of said groups for which the series of games is not completed, wherein at least some of said tables comprise groups advanced in the play of their series and groups beginning in the play of their series;

k) continuing a second round of said tournament with said non-eliminated winners.

11. The method as claimed in claim 10, wherein said gaming table has places for eight players, each said group comprising two players essentially facing each other across said table.

12. The method as claimed in claim 10, wherein said card game is Texas Hold'Em.

13. The method as claimed in claim 10, wherein said second round is played by repeating steps (b) through (k).

14. A method of delivering a broadcast entertainment program, the method comprising:

selecting a table card game having rules suitable for play by four or more players at a table under control of a dealer to deal cards, manage bets, determine a winner and provide a corresponding payout; providing a gaming table with places for said players arranged to play in at least two groups of at least two of said players;

providing a dealer button for each said group;

providing a match button to determine a starting group at said table;

managing bets from said players and determining said winner and corresponding payout in accordance with said rules of said game within each of said groups, beginning with the staffing group determined by the match button;

dealing cards to said players in accordance with said rules of said game as if said players were part of a single group; collecting information for spectators of said game including cards dealt to and bets made by each one of said players;

organizing said information for spectators to follow said game as played within each of said groups at said table; and broadcasting said information for spectators within said entertainment program.

15. The method as claimed in claim 14, wherein said gaming table has places for eight players, each said group comprising two players essentially facing each other across said table.

16. The method as claimed in claim 14, wherein said card game is Texas Hold'Em.

17. The method as claimed in claim 16, wherein said rules provide for elimination of a player after play of multiple games until a non-eliminated winner of a series of games is completed, further comprising determining when a series of games is completed for each of said groups of said players, and continuing play of said game for a remainder of said groups.

18. The method as claimed in claim 17, wherein when a series of games is completed for one of said group of players, said one of said group of players is replaced by a new group of players.

19. The method as claimed in claim 14, wherein said rules provide for elimination of players after play of multiple games until a non-eliminated winner of a series of games is completed, further comprising determining when a series of games is completed for each of said groups of said players, and continuing play of said game for a remainder of said groups.

20. The method as claimed in claim 19, wherein when a series of games is completed for one of said group of players, said one of said group of players is replaced by a new group of players.

21. The method as claimed in claim 14, wherein each said group comprises two players essentially facing each other across said table, and players from a same side of said table belong to a same team, further comprising determining a winning team from a number of players from a same team who have won in their respective groups.

22. The method as claimed in claim 14, wherein each said group comprises a same number of players.

23. The method as claimed in claim 9, wherein betting amounts are transferred between players on a same said team.

* * * * *